US006748090B1

(12) United States Patent
Bachmann et al.

(10) Patent No.: US 6,748,090 B1
(45) Date of Patent: Jun. 8, 2004

(54) MULTI-MODE RADIATOR PANELS

(75) Inventors: Wolfgang Bachmann, Grevenbroloh (DE); Gerhard Krump, Schwarzach (DE); Hans-Juergen Regl, Duesseldorf (DE)

(73) Assignee: Harman Audio Electronic Systems GmbH, Straubing (DE)

( * ) Notice: Subject to any disclaimer, the term of this patent is extended or adjusted under 35 U.S.C. 154(b) by 0 days.

(21) Appl. No.: 09/395,575

(22) Filed: Sep. 14, 1999

(30) Foreign Application Priority Data

Sep. 19, 1998 (DE) ..... 198 43 079

(51) Int. Cl.[7] ..... H04R 25/00; G10K 13/00

(52) U.S. Cl. ..... 381/152; 381/431; 381/161; 381/398; 381/423; 181/167; 181/171; 181/161

(58) Field of Search ..... 381/423–428, 381/190, 152, 417, 412, 433, 431, 161, 398, 160; 181/167–170, 161

(56) References Cited

U.S. PATENT DOCUMENTS 2,063,945 A 12/1936 Pierce ..... 181/31
3,247,925 A * 4/1966 Warnaka (List continued on next page.)

FOREIGN PATENT DOCUMENTS

| | | |
|---|---|---|
| DE | 196 30 701 C2 | 1/1998 |
| DE | 1957098 A1 | 6/1999 |
| DE | 197 57 097 A1 | 6/1999 |
| DE | 19757097 A1 | 6/1999 |
| GB | 2010637 * | 11/1978 |
| WO | WO 92/03024 | 2/1992 |
| WO | WO/ 92/03024 | 2/1992 |
| WO | WO 97/09842 | 3/1997 |

OTHER PUBLICATIONS

U.S. patent application Ser. No. 09,395,575, Kumada, filed Oct. 1982.*

F. G. Leppington et al.; "The Acoustic Transmission Properties of Anisotropic Sandwich Panels with Perforations", Proc. R. Soc. London A 428. 27–47 (1990).

*Primary Examiner*—Curtis Kuntz
*Assistant Examiner*—Dionne Harvey
(74) *Attorney, Agent, or Firm*—Foley Hoag LLP

(57) ABSTRACT

The invention relates to a system with multi-mode radiator panels used to reproduce sound. The multi-mode radiator panels include at least one driver, a core layer and two cover layers connected to the core layer. The panels are typically mounted in a frame with attachments providing a connection between the frame and the unit formed of the core layer and the cover layers. To protect the system against overload and damage, the entire driver electronics is housed in a hermetically sealed air space located between the frame, the core layer and the attachments. The driver electronics includes a power amplifier powered by low-voltage power supply. The voltage supply may be buffered by a battery to keep the average power supplied to the electronics small, while still being able to reproduce infrequently occurring peak power events. Buffering of the battery has the additional advantage that if the power supply is completely interrupted, the battery enables the sound reproduction to continue for a certain time in the event of a power failure, which is important for transmitting emergency announcements. The multi-mode radiator panels can also be connected via a bus, so that a single cable strand may be used to supply the acoustic signal and the electric power.

22 Claims, 2 Drawing Sheets

U.S. PATENT DOCUMENTS 3,941,932 A * 3/1976 DHoogh
4,198,550 A * 4/1980 Matsuda et al.
4,352,961 A * 10/1982 Kumada
4,625,328 A * 11/1986 Freadman
5,031,222 A * 7/1991 Takaya
5,533,132 A * 7/1996 Button
5,702,230 A * 12/1997 Kraft
5,912,978 A * 6/1999 Eastty
6,160,898 A * 12/2000 Bachmann
6,170,603 B1 1/2001 Bachmann et al. ..... 181/150
6,243,472 B1 * 6/2001 Bilan
6,263,084 B1 7/2001 Cressman et al. ..... 381/164
6,269,168 B1 * 7/2001 Tagami
6,275,598 B1 8/2001 Bachmann et al. ..... 381/425
6,347,149 B1 2/2002 Bachmann et al. ..... 381/396
6,369,943 B1 4/2002 Bachmann et al. ..... 359/445
6,386,315 B1 * 5/2002 Roy
6,494,289 B1 12/2002 Bachmann et al. ..... 181/173
6,560,348 B1 5/2003 Bachmann et al. ..... 381/425
2001/0017927 A1 8/2001 Bachmann et al. ..... 381/395
2001/0055403 A1 12/2001 Bachmann et al. ..... 381/190

* cited by examiner

MULTI-MODE RADIATOR PANELS

FIELD OF THE INVENTION

The invention relates to multi-mode radiator panels, in particular to supplying and processing signals for multi-mode radiator panels.

BACKGROUND OF THE INVENTION

Multi-mode radiator panels for radiating sound are known in the art and include essentially a flat sound panel which is driven by at least one electrodynamic driver connected to the sound panel. Further details relating to the design and operation of such multi-mode radiator panels are disclosed, for example, in the patent DE19757097 and DE19757098 which relate to the subject matter of the present invention.

If such multi-mode radiator panels are used to reproduce sound, then a respective driver electronics has to be provided for processing the received and generated sounds signals before these are supplied to the drivers. The multi-mode radiator panels operating in this fashion can be employed as individual sound reproduction devices. More often, however, the multi-mode radiator panels are used as so-called "acoustic walls" and include a plurality of multi-mode radiator panels which are arranged side-by-side and connected to each other. Conventionally, the driver electronics is essentially formed of an amplifier and filters integrated in the respective signal paths. With this technique, however, the technical specification of the different individual components disadvantageously have to be oversized to provide versatility for different applications. Since the drivers have to supply approximately 10 to 100 watts of power, special connectors for the signal paths, extremely low loss cables, expensive shielding, large power reserves and large tolerances of the impedances may be required depending on the application.

It therefore would be desirable to provide a multi-mode radiator panel which requires a less complex driver electronics.

SUMMARY OF THE INVENTION

According to one aspect of the invention, the entire driver electronics is integrated in the air space of the respective multi-mode radiator panel. In this way, the multi-mode radiator panels can be connected easily with one another and/or with a signal source receiving or generating the acoustic signals. Alternatively or in addition, each of the multi-mode radiator panels, which are combined to form an acoustic wall, may have the entire driver electronics in the air space. In the case of multi-mode radiator panels of an acoustic wall which is be optimized for radiating sound at high frequencies, the entire driver electronics may be distributed over the air space of the multi-mode radiator panels radiating sound over this frequency range. It is particularly advantageous if the mounting devices which connect the multi-mode radiator panel with the frame, hermetically enclose the air space enclosed between the frame and the multi-mode radiator panel, since then the multi-mode radiator panel and the driver electronics located in the air space may then also be operated without problem in listening areas which pose an explosion—hazard or are subjected to a hostile environmental and/or climate.

The driver electronics referred to in this application includes the audio electronics, which includes the power amplifier and associated filters for separating the various frequencies or frequency ranges, and the communication electronics which connects the electronics with an acoustic signal source and/or connects different multi-mode radiator panels with each other, if several multi-mode radiator panels are combined to form, for example, an acoustic wall. The communication electronics also forms, when a command dialog is entered, the interface between commands entered by a user and the driver electronics and/or a multimedia center connected to the multi-mode radiator panel. The driver electronics also includes a battery buffer which is connected to the remaining driver electronics. It will be understood by those skilled in the art that the driver electronics need not include all the above-referenced components. In other words, for example, the battery buffer need not be implemented if the power supply is able to satisfy peak power requirements.

According to one embodiment of the invention, the driver electronics may include a power amplifier matched to a respective driver. In this case, the power amplifier can be optimized for that driver. Unlike in conventional driver electronics, where an individual amplifier typically powers one or more drivers and where the amplifier and the drivers are often configured by the end-user, the power amplifier according to the invention need not include reserve power since the amplifier and the driver form a matched unit. Implementing the amplifier and the driver as a matched unit has the additional advantage that the different components are matched and can therefore be optimized with respect to each other, thereby reducing the likelihood of damage to the unit.

According to another embodiment of the invention, the driver electronics may include electronic filters either in analog or digital form. The power amplifiers and associated drivers can then be used in a cost-effective way to separate the different frequencies. This arrangement advantageously eliminates the power electronics required by conventional devices for separating the frequencies.

According to yet another embodiment of the invention, the driver electronics is powered by a DC power source. With this arrangement, the electric power and the acoustic signal can be supplied over common wires which connect the driver electronics to the acoustic signal source. In addition, unlike power amplifiers powered through the high-voltage mains, the low-voltage power supply according to the invention does not pose a hazard if plugs or receptacles are left unprotected.

According to still another embodiment of the invention, an additional power source for supplying peak power which may be required by drivers operating at low frequencies, can be eliminated by integrating in the air space a battery with a charging electronics powered by DC, wherein the battery supplies the required peak power. In addition, a capacitor may be connected in parallel with the battery to faithfully reproduce infrequently occurring short high-power spikes with low distortion. Buffering with a battery also ensures that the multi-mode radiator panels remain operational during emergencies, for example, during an interruption of the DC power supply, which can aid in securing escape routes. The charging electronics may be designed to prevent the charge state of the battery from dropping below a critical charge state which may occur, for example, when peak power is required over an extended time period. In this case, the acoustic volume may be automatically adjusted with dynamic compensation in when such low charge state is reached.

According to another embodiment of the invention, the (first) interface which connects the driver electronics with the acoustic signal source, may be implemented as a bus-enabled interface. With this arrangement, a multi-mode radiator panel can be operated wherever a corresponding bus is provided. In other words, if bus technology is available, the multi-mode radiator panel can become the sole end device.

According to yet another embodiment of the invention, the bus connected to the multi-mode radiator panel may also include the power supply system, if the respective power amplifier is powered by a DC power source. This arrangement provides for a flexible operation of the multi-mode radiator panel.

According to still another embodiment of the invention, a second interface may be provided for interconnecting several multi-mode radiator panels in form of a network and/or for receiving and transmitting a command dialog. The multi-mode radiator panels can thereby communicate with the power amplifier and/or a multimedia center via the second interface. For sake of flexibility, this communication channel may be wireless and implemented, for example, in infrared technology.

Further features and advantages of the present invention will be apparent from the following description of preferred embodiments and from the claims.

DETAILED DESCRIPTION OF PREFERRED EMBODIMENTS

Figure 1:
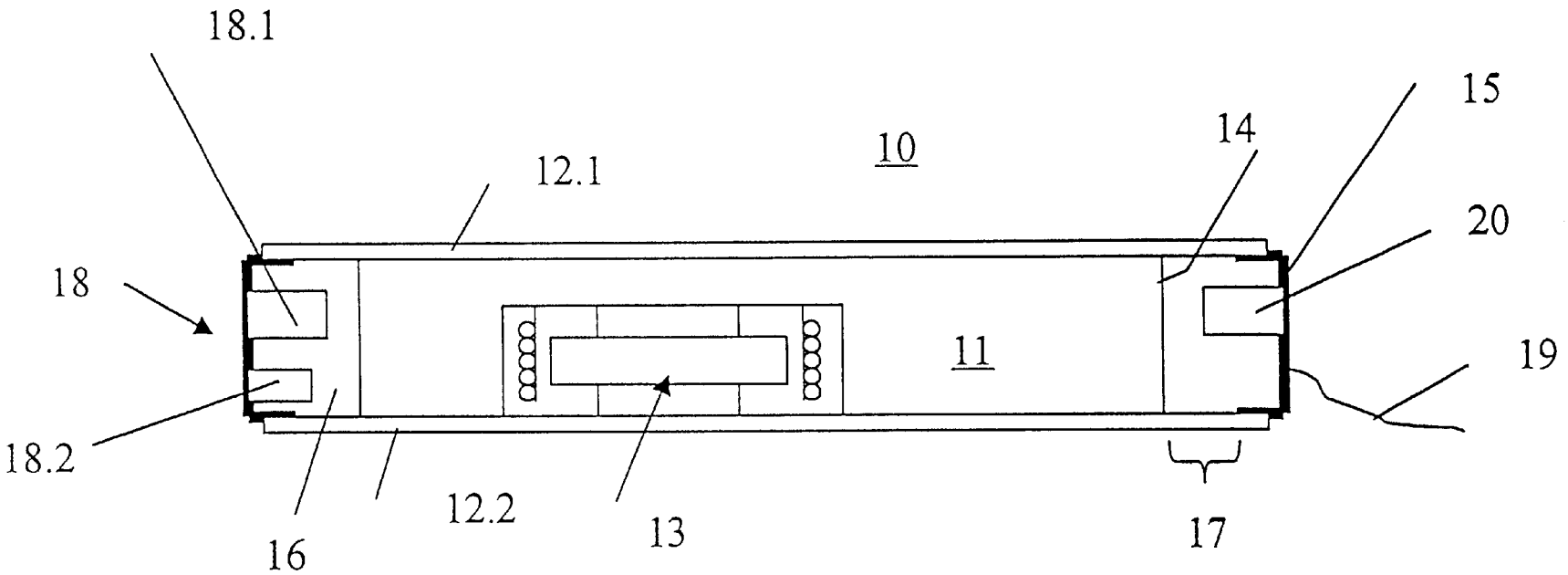
FIG. 1 shows a lateral cross-section of a multi-mode radiator panel according to the present invention.

FIG. 1 shows a lateral cross-sectional view of a multi-mode radiator panel 10. The actual dimensions of the multi-mode radiator panel have been omitted from the drawing, since the dimensions are implementation-dependent in a manner that is straight-forward to one of ordinary skill in the art. The multi-mode radiator panel 10 is formed by a core layer 11 and two cover layers 12.1 and 12.2, wherein the surfaces of the core layer 11 with the largest surface area are connected with the cover layers 12.1, 12.2. Connected to the multi-mode radiator panel 10 is at least one driver 13 which excites oscillations in the multi-mode radiator panel 10. The specific design and location of the exemplary driver 13 shown in FIG. 1 is in no way intended to limit the scope of the present invention.

A frame 15 having a lateral spacing from narrow sides 14 of the core layer 11 surrounds the multi-mode radiator panel 10, thereby providing an air space 16 between the narrow sides 14 and the frame 15. The multi-mode radiator panel 10 is suspended in the frame 15 by a suspension element 17. In the exemplary embodiment, the suspension element 17 is formed by the two cover layers, 12.1, 12.2 which extend to the frame 15 and are connected thereto. The connection between the two cover layers 12.1, 12.2 and the frame around the circumference of the frame hermetically seals the air space 16, leaving only the outer surfaces of the frame 15 and of the cover layers 12.1, 12.2 exposed to the environment. The latter surfaces can easily be made resistant against the environmental hazards and/or hazardous materials, so that the multi-mode radiator panels 10 of the invention can be exposed to harsh conditions regardless of other components located inside the multi-mode radiator panel 10.

The suspension element 17 can be under tension when connected to the frame which improves the reproduction of low-frequency sound.

As also seen in FIG. 1, driver electronics 18 may be housed entirely in the air space 16. The driver electronics 18, which may also have an overload protection (not shown), may include a power amplifier 18.1 which is optimized for the driver 13 and a filter arrangement 18.2. The advantages of integrating the driver electronics 18 and the driver 13 are discussed above. Moreover, if several drivers 13 are connected to the multi-mode radiator panel 10, the power amplifier 18.1 may be integrated with the multi-mode radiator panel 10 to save cost. Alternatively, if several multi-mode radiator panels 10 are arranged side-by-side, a single power amplifier 18.1 may be used to power drivers 13 associated with different multi-mode radiator panels 10.

The frame 15 may be formed of a metal and/or provided with cooling fins (not shown) to efficiently remove heat from the driver electronics 18.

Advantageously, the power amplifier 18.1 is powered by a DC voltage instead of the high-voltage mains. This reduces hazards associated with bodily contact with open terminals and, at the same time, makes it possible to route the power and the acoustic signals over a single cable 19. Unlike multi-mode radiator panels 10 without an integrated amplifier, the multi-mode radiator panels 10 of the present invention may require a significantly less complex and expensive acoustic signal cable (not shown), since the signal is only amplified in the multi-mode radiator panel itself.

As also seen in FIG. 1, a battery 20 which is charged by a DC-powered charging electronics, is integrated in the air space 16. The battery 20 supplies to the driver(s) 13 the necessary voltage during peak power requirements. When peak power is not demanded, the charge state of the battery 20 is tested and the battery is recharged as required. For example, when the test of the charge state reveals that the charge of the battery 20 is low, the acoustic volume may be automatically decreased and the dynamic range compressed. A particularly distortion-free reproduction of infrequent peak power events can be attained by connecting a capacitor (not shown) in parallel with the battery 20. Alternatively or in addition, the electronics connected with the battery 20 can be modified so that in the event of a malfunction of the external DC power source (not shown), the battery 20 will still be able to provide an adequate sound reproduction, such as being able to make important announcements for securing escape routes in case of an emergency.

Figure 2:
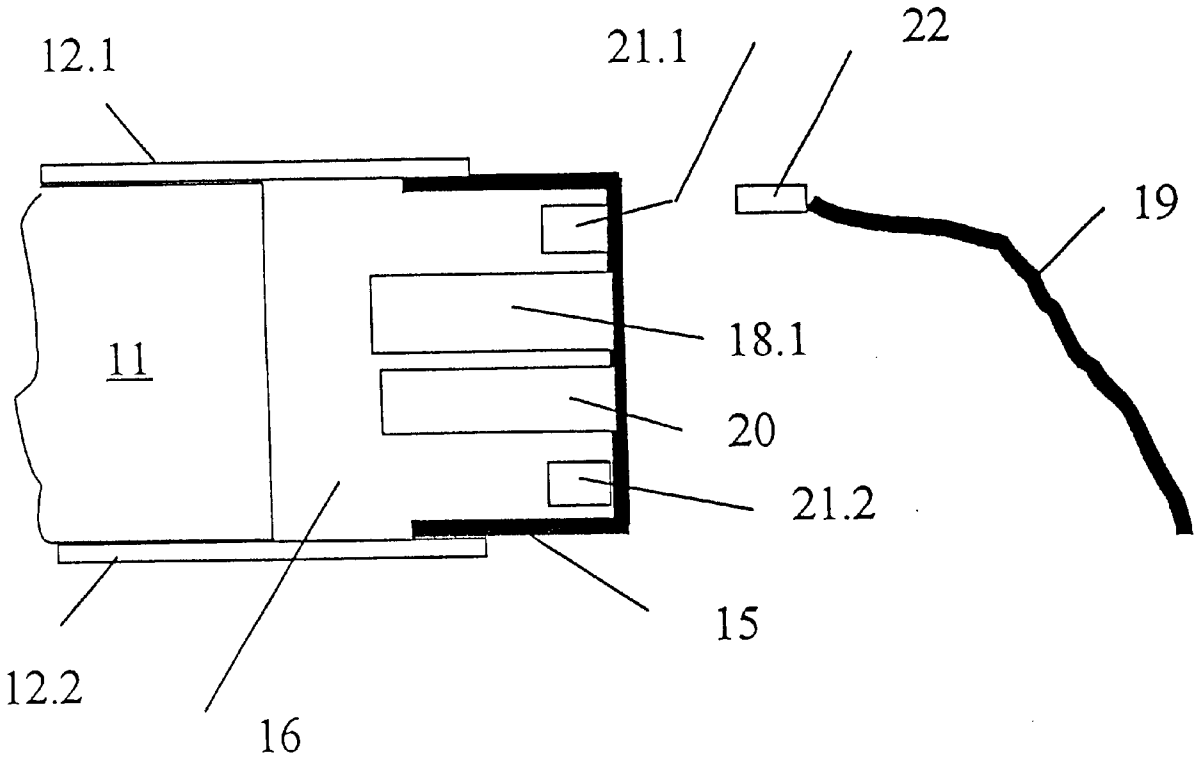
FIG. 2 illustrates an installation of the multi-mode radiator panel according to the present invention.

FIG. 2 shows the frame 15 of the multi-mode radiator panel 10 of FIG. 1 in an enlarged scale. Included in the air volume 16 of multi-mode radiator panel 10 is the power amplifier 18.1 and the battery 20, as well as a first interface 21.1 and a second interface 21.2. The acoustic signals are supplied via the first interface 21.1 by connecting the interface 21.1 with the connector of the cable 19. The illustrated interface/connector combination can be implemented, for example, as a glass fiber or bus connection, if the interface 21.1 is used exclusively for supplying the acoustic signals. Alternatively, a conventional connection via loudspeaker jacks and loudspeaker plugs may be used. Advantageously, the interface/connector combination may be implemented as a bus connection, which can supply not only the acoustic signals but also the electric power.

If the first interface 21.1 supplies only the electric power for the power amplifier 18.1 and the battery 20, then a second interface is required for supplying the acoustic signals to the power amplifier. By separating the acoustic signals from the supplied electric power, the acoustic signals may be transmitted wireless. In this case, the second interface 21.2 may be implemented as an infrared sensor.

Even if the first interface 21.1 alone supplies the multi-mode radiator panel 10 with both electric power and acoustic signals, then the second interface 21.2 can be used to interconnect several multi-mode radiator panels in form of a network and/or to transmit the command inputs of the user via a command dialog provided in a conventional manner. The second interface 21.2 may also be implemented as, for example, a receiver sensor of a wireless transmission system, wherein the interface 21.2 can receive commands activated by a user, for example, with a remote control, and transfer these commands to the power amplifier 18.1 or to a multimedia center (not shown) connected through the first bus enabled interface 21.1.

It is to be understood that the embodiments and variations shown and described above are illustrative of the principles of this invention only and that various modifications may be implemented by those skilled in the art without departing from the scope and spirit of the invention.

What is claimed is:

1. A multi-mode radiator panel comprising:

an assembly formed of a core layer and two cover layers connected to opposing surfaces of the core layer;

a frame that surrounds the assembly so as to leave an air space between the frame and the assembly;

an attachment that connects the assembly with the frame and also enclosing the air space;

at least one driver, inside the core layer, effecting the assembly; and a driver electronics that powers the driver, wherein the driver electronics is completely integrated in the air space;

wherein the panel is capable of radiating sound.

2. The multi-mode radiator panel of claim 1, wherein the driver electronics includes a power amplifier which is optimized for the driver.

3. The multi-mode radiator panel of claim 1, wherein the driver electronics includes a filter arrangement.

4. The multi-mode radiator panel of claim 1, wherein the driver electronics is powered by a DC power source.

5. The multi-mode radiator panel of claim 1, further comprising:

a battery and a DC-supplied charging electronics for charging the battery, wherein the battery and the charging electronics are integrated in the air space.

6. The multi-mode radiator panel of claim 1, wherein the driver electronics includes a first interface which can be connected to at least one source of an acoustic signal.

7. The multi-mode radiator panel of claim 6, further comprising:

a second interface for at least one of interconnecting several multi-mode radiator panels to form a network and receiving and routing input of a command dialog.

8. The multi-mode radiator panel of claim 6, wherein the first interface is a bus-enabled interface.

9. The multi-mode radiator panel of claim 8, further comprising:

a second interface for at least one of interconnecting several multi-mode radiator panels to form a network and receiving and routing input of a command dialog.

10. The multi-mode radiator panel of claim 6, wherein the first interface comprises a DC power connection.

11. The multi-mode radiator panel of claim 10, further comprising:

a second interface for at least one of interconnecting several multi-mode radiator panels to form a network and receiving and routing input of a command dialog.

12. The multi-mode radiator panel of claim 1, wherein the air space is sealed by at least one of the frame and the attachment.

13. The multi-mode radiator panel of claim 1, wherein the air space is hermetically sealed by at least one of the frame and the attachment.

14. A multi-mode radiator panel, comprising:

an assembly that includes a core portion and a frame portion substantially surrounding the core portion so as to leave an air space therebetween;

at least one driver inside the core layer, effecting the assembly; and a driver electronics, disposed in the air space, that powers the driver;

wherein the panel is capable of radiating sound.

15. The multi-mode radiator panel of claim 14, further comprising:

a battery and a DC-supplied charging electronics for charging the battery, wherein the battery and the charging electronics are integrated in the air space.

16. The multi-mode radiator panel of claim 14, wherein the driver electronics includes a first interface which can be connected to at least one source of an acoustic signal.

17. The multi-mode radiator panel of claim 16, further comprising:

a second interface for at least one of interconnecting several multi-mode radiator panels to form a network and receiving and routing input of a command dialog.

18. The multi-mode radiator panel of claim 16, wherein the first interface is a bus-enabled interface.

19. The multi-mode radiator panel of claim 16, wherein the first interface comprises a DC power connection.

20. A multi-mode radiator panel comprising:

assembly means formed of a core layer and two cover layers connected to opposing surfaces of the core layer;

frame means that surrounds the assembly means so as to leave an air space between the frame means and the assembly means;

attachment means for connecting the assembly means with the frame means and also enclosing the air space;

at least one driver means, inside the core layer, for effecting the assembly means; and driver electronics means that powers the driver means, wherein the driver electronics means is completely integrated in the air space;

wherein the panel is capable of radiating sound.

21. The multi-mode radiator panel of claim 20, wherein the driver electronics means includes a power amplifier which is optimized for the driver means.

22. The multi-mode radiator panel of claim 20, wherein the driver electronics means includes a filter arrangement.

* * * * *